US005482065A

United States Patent [19]

O'Leary

[11] Patent Number: 5,482,065

[45] Date of Patent: Jan. 9, 1996

[54] INDUSTRIAL WASHING MACHINE

[75] Inventor: James O'Leary, Komoka, Canada

[73] Assignee: Clam Industries Incorporated, Lakeland, Fla.

[21] Appl. No.: 68,094

[22] Filed: May 28, 1993

Related U.S. Application Data

[63] Continuation-in-part of Ser. No. 745,338, Aug. 15, 1991, abandoned.

[30] Foreign Application Priority Data

Aug. 22, 1990 [CA] Canada ..... 2023822

[51] Int. Cl.[6] ..... B08B 3/02

[52] U.S. Cl. ..... 134/111; 134/141; 134/148; 210/522

[58] Field of Search ..... 134/104.1, 111, 134/112, 135, 138, 139, 141, 148, 103; 210/776, 314, 335, 522, 523, 540; 68/210

[56] References Cited

U.S. PATENT DOCUMENTS

| | | | |
|---|---|---|---|
| 2,264,912 | 12/1941 | Kupper | 210/523 X |
| 2,473,297 | 6/1949 | Parker | 210/522 X |
| 3,305,092 | 2/1967 | Turk | 210/523 X |
| 3,513,672 | 5/1970 | Macon et al. | 68/210 |
| 3,768,648 | 10/1973 | Anderson et al. | 210/522 X |
| 3,990,974 | 11/1976 | Sullins | 210/522 X |
| 4,333,835 | 6/1982 | Lynch | 210/522 X |
| 4,842,001 | 6/1987 | O'Leary | 134/138 |

*Primary Examiner*—Frankie L. Stinson
*Attorney, Agent, or Firm*—McFadden, Fincham

[57] ABSTRACT

There is disclosed an industrial washing machine which includes a casing with a lid, a liquid reservoir within the casing and a collecting area associated with the reservoir. The washing machine further includes a cover adapted for covering the collection area and the liquid reservoir. Cooperating with the cover is a filter assembly which is disposed within the casing. Further, an assembly is included which effects the movement of floating grease and oil from the liquid within the reservoir. This floating grease and oil is directed by the assembly towards a fixed point within the casing for collection and eventual removal.

10 Claims, 8 Drawing Sheets

INDUSTRIAL WASHING MACHINE

This application is a continuation-in-part of application Ser. No. 07/745,338, filed Aug. 15, 1991 and now abandoned.

FIELD OF THE INVENTION

The present invention relates to an improved industrial washing machine having a rotating parts basket and an internal liquid reservoir from which cleaning liquid is pumped about and at the rotating basket for rotation thereof, while cleaning the parts thereon. The invention provides filtering means and liquid surface skimming means to aid in the removal of grease and oil from the washing liquid.

BACKGROUND OF THE INVENTION

There is presently a need for an efficient industrial washing machine capable of effectively and thoroughly cleaning many different types of industrial products. This need is particularly felt in the automotive industry for the cleaning of automotive parts, such as transmissions and the like.

Attempts have been made in the past to produce automotive parts cleaning machines, however, these machines are subject to different mechanical problems, such as pump failure because the pumps are generally operated at relatively high pressures and subject to pressure variances caused as a result of spray line blockage problems and the like. In addition, these prior art machines generally use relatively sophisticated drive and brake assemblies for controlling basket speed rotation which can, again, be subject to different maintenance problems.

The existing industrial washing machines have only met with limited commercial success because they are often ineffective from a cleaning standpoint. One of the primary reasons for this problem is the recycling of relatively unclean washing solution onto the articles in the machine.

Over the last few years there has been a very strong move to improving the safety of industrial equipment in general, and therefore like many other fields there is a need for an advance in the state of the art with respect to the safety of industrial washing machinery.

SUMMARY OF THE INVENTION

The present invention is directed to improvements for an industrial washing machine having a casing with a lid, a cleaning fluid reservoir and a grease collecting trough therein. More particulary, one aspect of the industrial washing machine of the present invention includes a sloping cover member for covering the reservoir which directs wash water cascading thereover into a filtering means located internally of the casing. Disposed under the cover is located a liquid surface skimming means which aids in the removal of grease and oils from the surface of the fluid in the reservoir. The skimming means directs the oils etc. to the grease collecting trough within the casing of the machine, while highly dense oil and grease or an agglomerations thereof are removed from the cleaning liquid by the filtering means.

One object of the present invention is to provide an industrial washing machine having a casing with a lid, a liquid reservoir therein and a collecting means associated with the reservoir, the improvement comprising:

a cover positioned within the casing and extending over the reservoir covering the collecting means and the liquid reservoir;

filter means associated with the cover and disposed within the casing; and means beneath the cover for acting on a surface of a liquid in the liquid reservoir for effecting lateral movement of floating grease and oil from the liquid in the liquid reservoir towards a fixed point for collection of the grease and oil in the collecting means within the casing and whereby wash water from a wash cycle flows laterally over the cover into the filter means for removal of debris, the wash water flowing subsequently into the reservoir.

Another object of the present invention is to provide a fluid system for raising and lowering a member, comprising:

first and second double-acting pneumatic cylinders attached to the member at spaced positions;

a fluid supply to each end of each cylinder;

a flow control valve for each end of each cylinder;

a stop valve associated with each flow control valve for one end of each cylinder;

a control valve for actuating the stop valves to an open condition;

means for actuating the flow control valves to admit fluid to each cylinder at a selected end, and to permit flow of fluid from each cylinder at its non-selected end; and the stop valves actuated to permit flow of fluid and stop flow of fluid as selected.

Yet another object of the present invention is to provide a surface draining apparatus for removing a surface layer from a body of liquid comprising:

a tray positioned at a predetermined liquid level;

means for injecting air into the body of fluid approximately at the liquid level to move the surface layer toward the tray;

means for feeding additional fluid to the body of fluid to raise the liquid level and cause the surface layer to overflow into the tray; and means for draining collected surface liquid from the tray.

A still further object of the present invention is to provide a method of surface draining for removing a surface layer from a body of liquid comprising:

providing a tray position at a predetermined liquid level;

injecting air into the body of fluid approximately at the liquid level to move the surface layer toward the tray;

feeding additional fluid to the body of fluid to raise the liquid level and cause the surface layer to overflow into the tray; and draining collected surface liquid from the tray.

Thus, in one embodiment of the present invention there is provided an improvement over the prior art by acting on the surface on a liquid in a reservoir to create a lateral flow of the liquid surface thereby causing the surface layer with contained matter to move across to a separate drain member. Still further, the present invention provides a two-stage treatment in that, for example, agglomerated oil and sand particles can be removed by a filter while lighter oils are, for example, extracted by the surface movement in a reservoir.

Still further, the present invention provides significant advantages in that in certain prior art arrangements, wash water is not fed to a filter from a cover means followed by the wash water going to a filter. Moreover, the present invention provides the advantage of a combination and arrangement of a first stage filtration followed by a lateral displacement of the water surface in a reservoir for a secondary treatment for removal of undesired contaminants such as grease.

Having thus generally described the invention, reference will now be made to the accompanying drawings illustrating preferred embodiments.

DETAILED DESCRIPTION OF THE PREFERRED EMBODIMENTS

Figure 1:
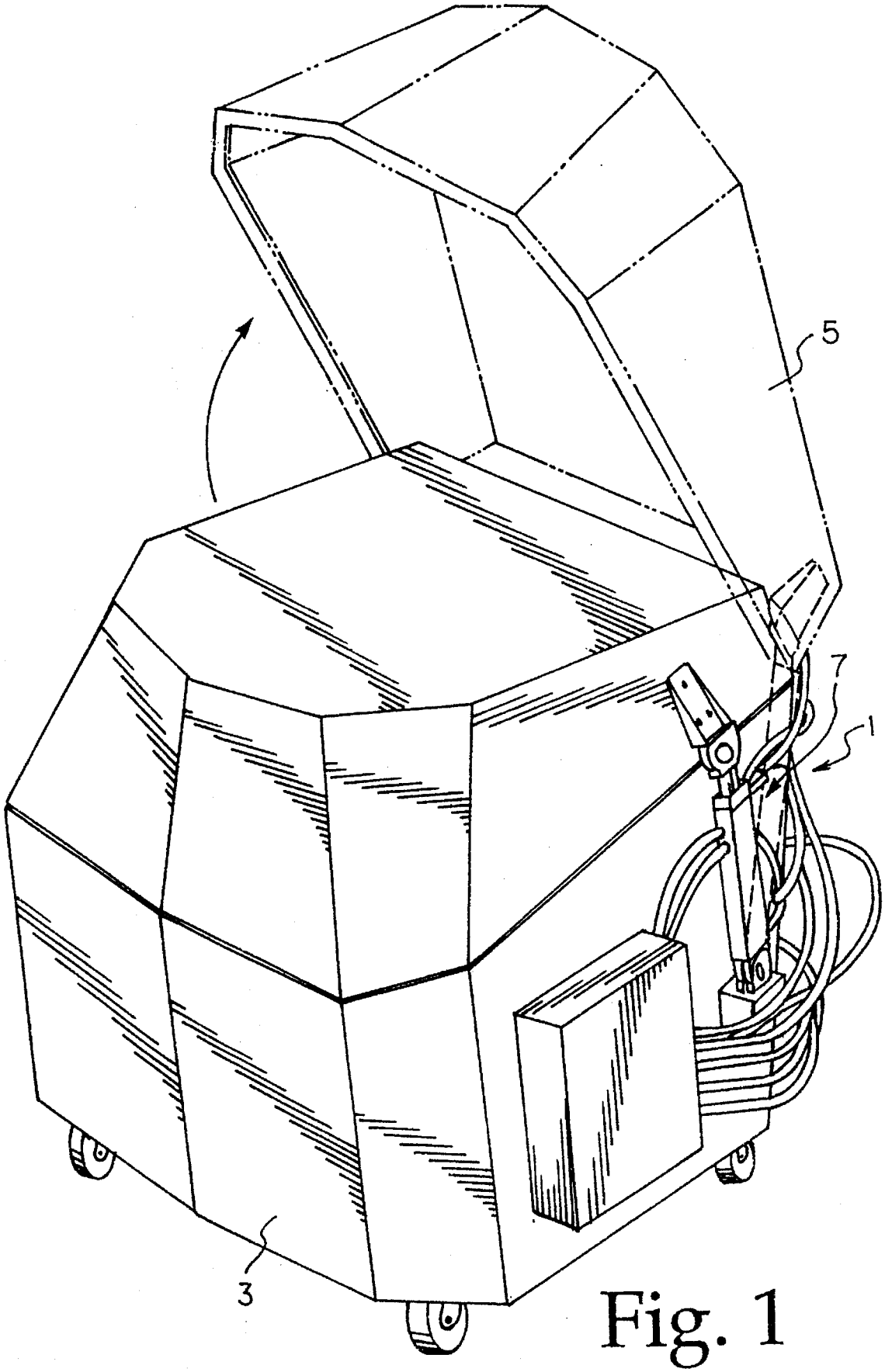
FIG. 1 is a perspective view of the industrial washer according to a preferred embodiment of the present invention.

FIG. 1 shows an industrial washing machine, generally indicated at 1. This machine comprises a casing 3 having a lid 5 with lid actuation means 7 on either side of the machine (hereinafter disclosed).

Figure 2:
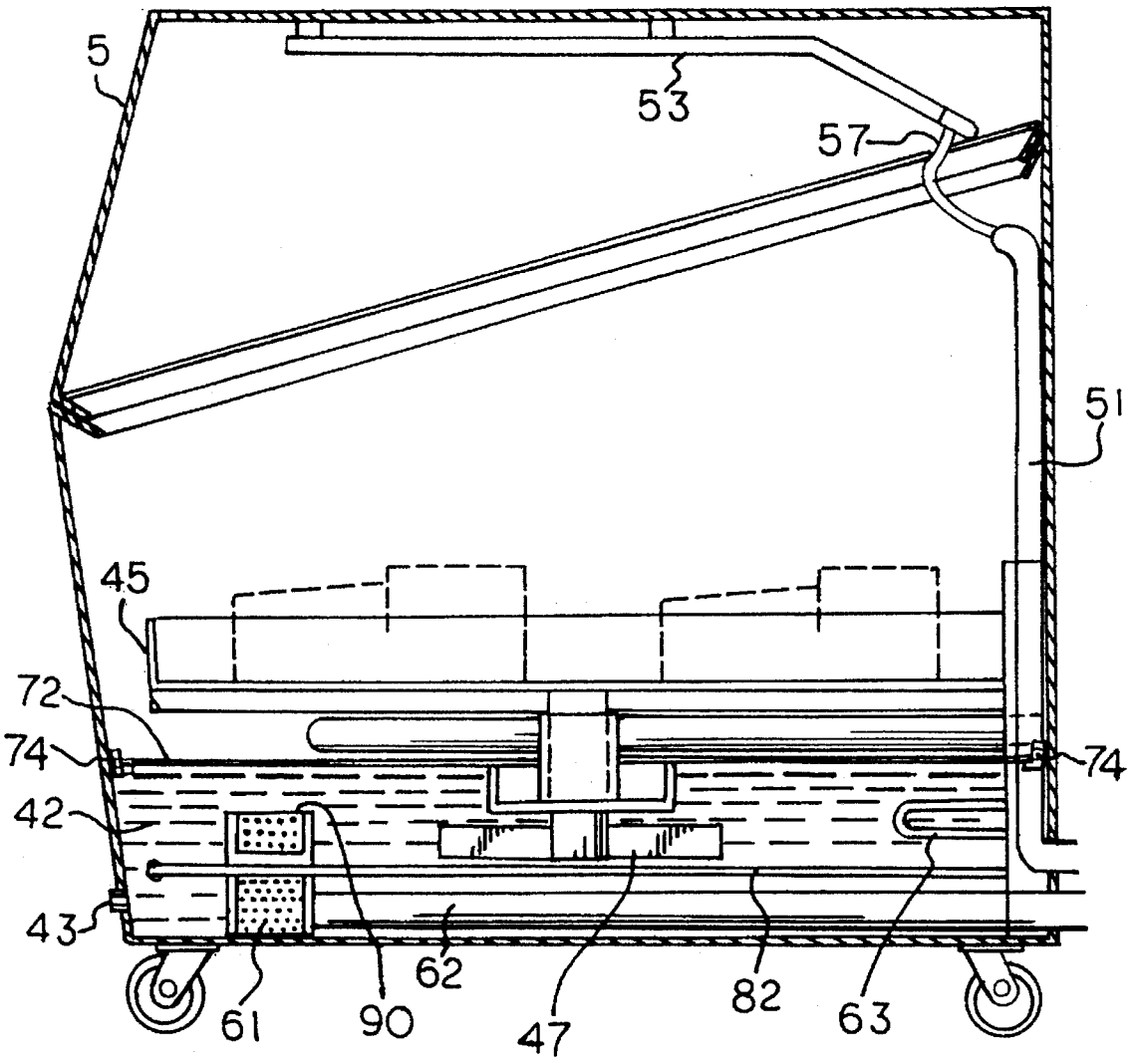
FIG. 2 is a sectional view through the industrial washer of FIG. 1.
Figure 3:
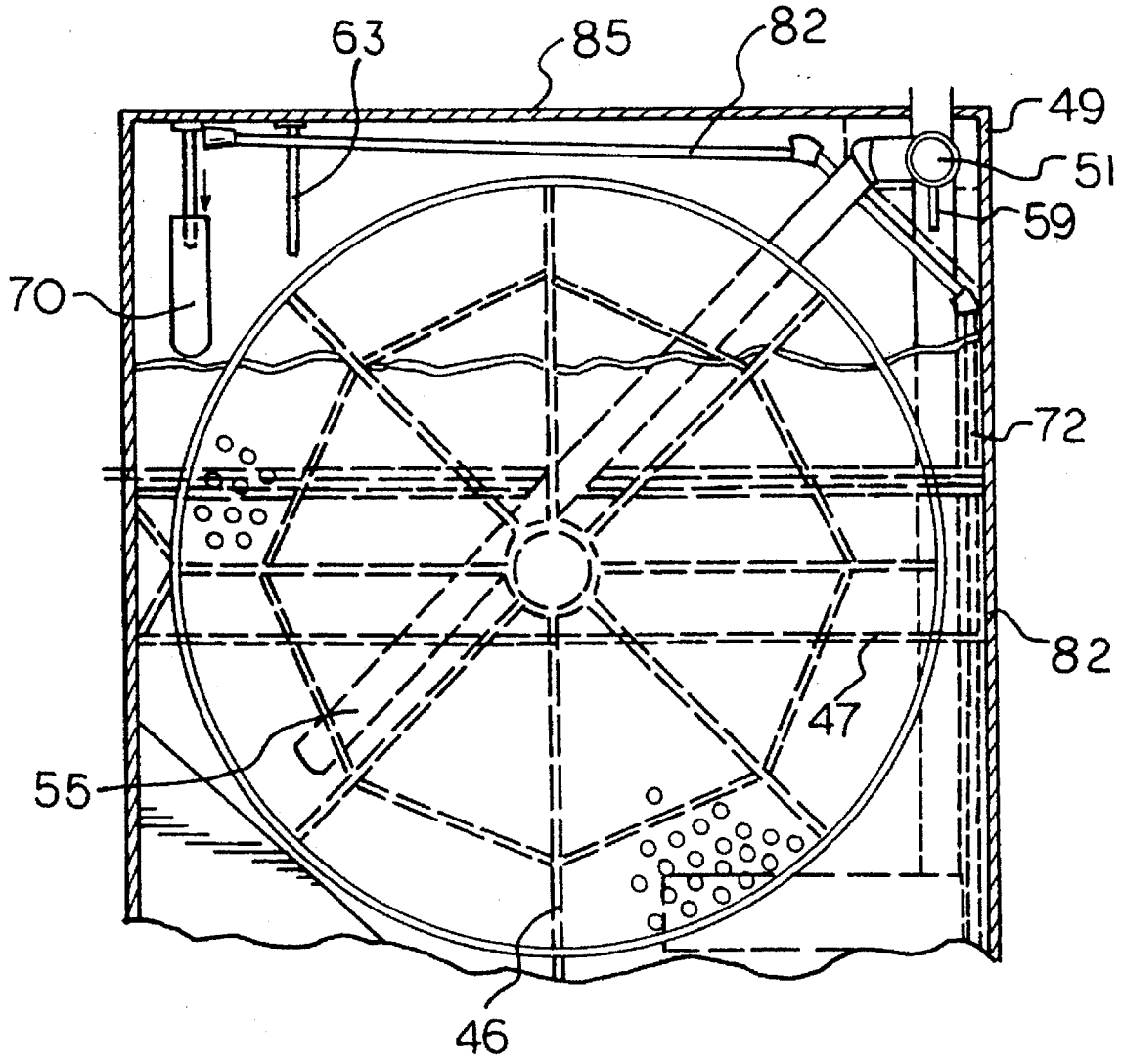
FIG. 3 is a top plan view of the operation of the internal components from the washer of FIGS. 1 and 2.
Figure 4:
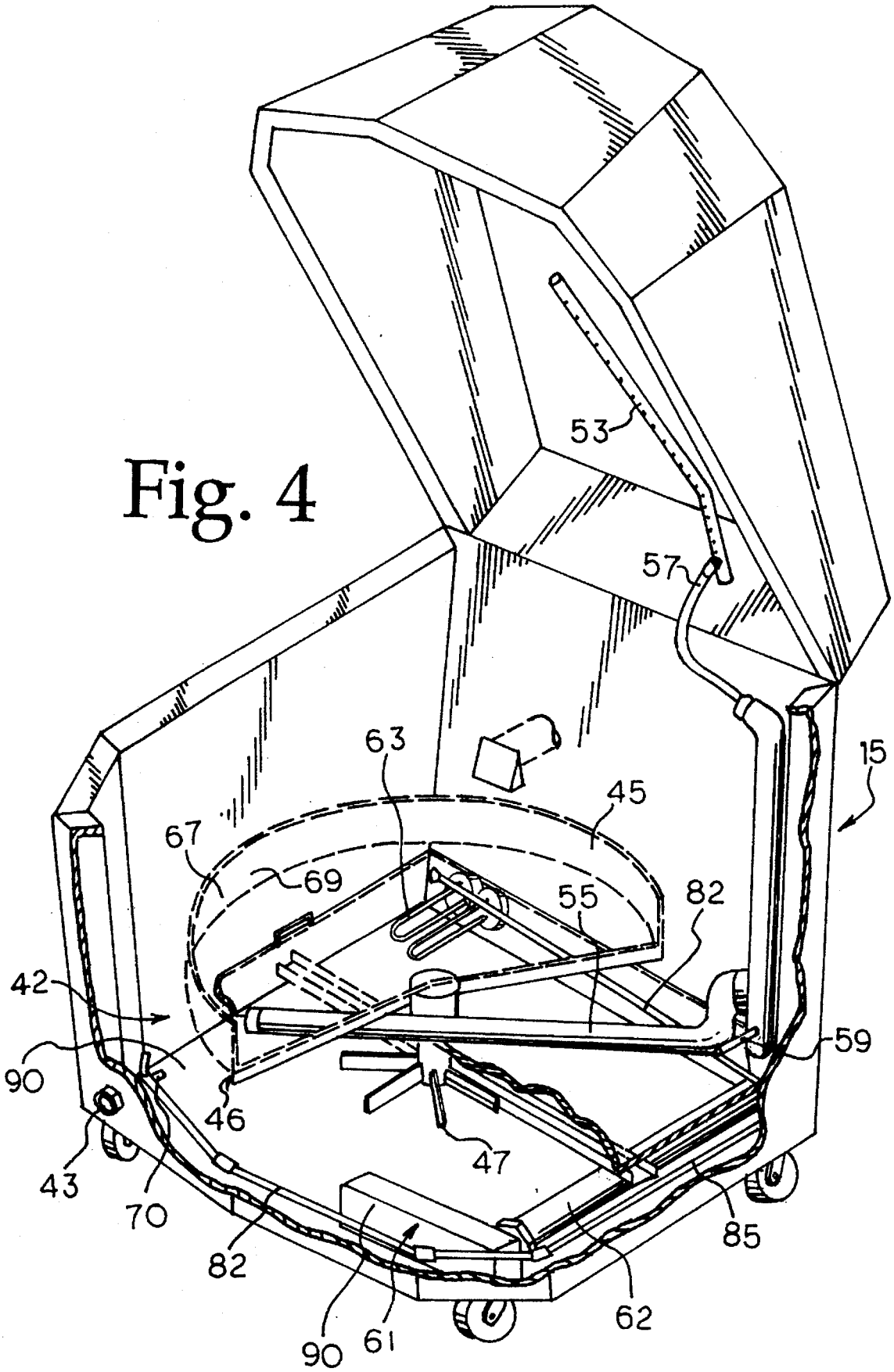
FIG. 4 is a perspective view of the industrial washer, more clearly illustrating the internal components.

Referring to FIGS. 2, 3, and 4 shown is the internal working assembly for the machine. More specifically, the machine includes an internal liquid reservoir 42, which is filled with water through inlet 44 also used to top up the reservoir when required. Located above the reservoir 42 is a sloping removable cover member 72 which rests on a ledge 74. The ledge 74 disposed about the internal periphery of the casing 3 projects outwardly and slightly downwardly e.g. one inch slope across the width and is normally to the inside surface of the casing 3. The downward projection of the ledge 74 permits a cover member 72 (hereinafter described) to be sloped when positioned on the ledge 74. Located above the reservoir 42 is a rotatable parts basket 45 into which different industrial parts such as, for example, automotive transmissions are loaded for cleaning purposes. Extending down from and rotatably coupled to the parts basket is a paddle brake 47. Provided on the bottom of the basket itself are a plurality of vanes 46.

Figure 5:
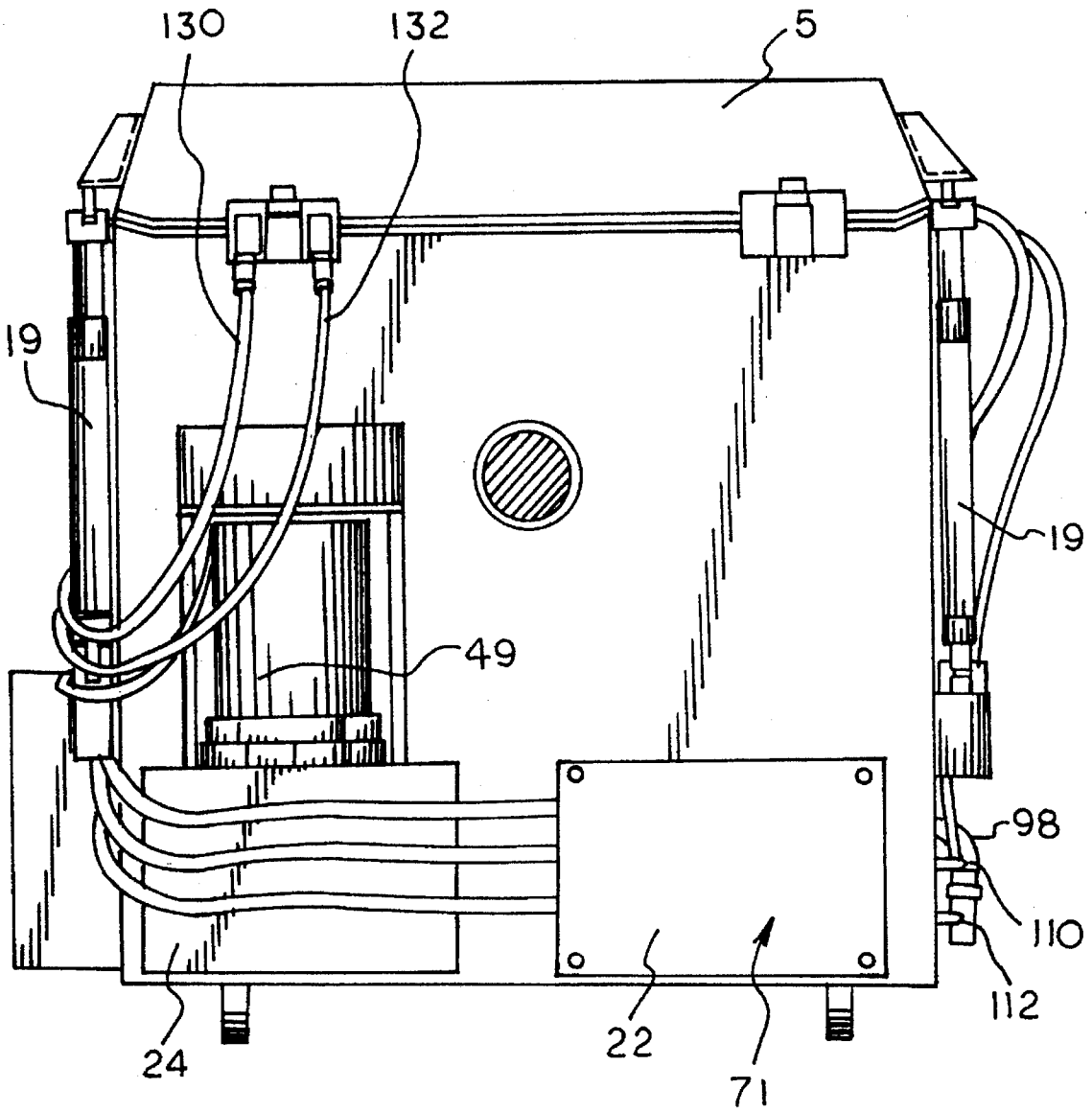
FIG. 5 is a rear perspective view of the washer of FIG. 4.

A water pump 49 is located at the rear of the machine, more clearly illustrated in FIG. 5, for drawing water from the liquid reservoir and pumping it under pressure via conduits 130 and 132 through a spray bar assembly directed at the cleaning basket. This spray bar assembly includes a vertical section 51 extending through a flexible coupling 57 to a horizontal section 53 secured to the inside of the lid and aimed downwardly at the parts basket. The flexible coupling allows lifting of the lid with sections 51 and 53 remaining coupled to one another. A further horizontal spray bar section 55, common to the same spray bar assembly, is provided beneath and directed upwardly at the parts basket.

A jet member or nozzle 59 offshooting from spray bar 51 provides a jet stream under pressure from pump 49 for rotating the parts basket.

Provided within reservoir 42 are immersion heaters 63 for heating of the cleaning liquid which is generally kept at about 160° F. The immersion heaters 63 preferably extend inwardly from housing 71 containing the same. The heaters may include removable sleeves 70 which preferably comprise a material not susceptible to attack by the detergents, grease or oil from the washing cycle and, which additionally allow the heat to radiate therethrough; such material may include, for example, glass, polyethylene, etc. These may be removed for cleaning by entering the housing 71. As well, within the reservoir 42 there is included means 82 for effecting the movement of the liquid surface hereinafter described, which aids in the removal of e.g. grease, oil, etc. from the wash water in the machine. Located above the liquid reservoir is a vent 65, opening through the back of the machine.

Provided to the rear outside of the machine are electrical boxes 22 and 24. Box 22 houses the electrical components for the immersion heaters 63, while box 24 houses the electrical components for pump 49, actuation means 7 etc. Additionally, the function box 22A for operating the lid, wash cycle, and other operation functions for the machine, is included on the side of the casing 3.

The first stage in operating the machine is the filling of the liquid reservoir 42 by an outside water supply through inlet 44. The reservoir is filled to the approximate level as shown in FIG. 2. Located within the reservoir is a porous detergent or soap loader 61 having a sleeve 90 thereover which is connected directly with pump 49 by means of hose 62.

With the liquid reservoir appropriately filled, pump 49 is turned on to draw a mixture of water and detergent from the soap loader through line 62 and force the mixed cleaning solution upwardly into the spray bar assembly. The various different sections are provided with a series of small openings which, as seen in the drawings, are directed to substantially cover the entirety of the parts basket. At the same time, the cleaning solution is forced outwardly through jet member of nozzle 59, as best shown in FIG. 3, directed at the vanes on the bottom of and rotating the parts basket. Accordingly, the same water supply is used to both provide the cleaning spray through the spray bar assembly and the rotational drive for the parts basket through the jet stream.

It is essential that the speed of the parts basket be controlled to prevent the basket from free wheeling which could otherwise damage both the machine and the parts basket. This control is accomplished by means of the paddle assembly 47 which effectively acts as a braking device within the liquid reservoir. To assist in the braking action, jet 59 is set up to rotate the basket in the direction of arrow 45*a*, while pump 49 circulates the water through detergent loader 61 in the opposite direction, i.e. the water is circulated in a direction opposite to that in which the basket is rotated so that the paddle brake 47 is always rotating against the brake by the current in the reservoir.

In conventional automotive parts washers, a soft wash, i.e. the pressure of the spray cleaning, is considered to be about 70 lbs. per square inch with hard washes ranging anywhere from 200 to 1200 lbs. per square inch. However, operating at these high pressures is not only hard on the pump but can also cause damage to certain automotive parts and in fact cannot be used in flushing out radiators and transmission coolers where the spray pressure should not exceed 50 lbs. per square inch.

In the case of the present invention, the cleaning spray pressure is preferably at about 34 to 36 lbs. per square inch and is controlled not to exceed about 44 lbs. per square inch. The cooperation between the spray bar and the jet nozzle act as a safety guard in preventing undesirably high spray pressures. Since the jet nozzle, which is of a substantially increased bore e.g. something in the neighbourhood of about 1.1 inches versus the much smaller spray bar holes at about 2.4 mm. provides an overflow relief against spray pressure increase. For example, should any of the holes in the spray bar become blocked the jet nozzle becomes the path of least resistance and picks up the greater portion of directed liquid flow which would otherwise have resulted in a correspondingly greatly increased spray pressure through the non-blocked spray bar holes.

As stated above, it is also important that the parts basket be maintained at a controlled rotational speed. Again, this is achieved by means of the paddle brake physically located in the liquid reservoir and guarding against increased basket speeds, even when there is additional flow from the jet nozzle.

From a simplicity of construction standpoint, the holes in the spray bar may be drilled jets having a relatively random pattern covering the parts basket without any specific preciseness to the individual holes. Therefore, if they wear or do become blocked, the entire bar can simply be welded and redrilled without having to actually replace the bar. This is to be compared to conventional machines where fishtail type jets are used which, if blocked or damaged, require substantially more maintenance or even replacement of the entire spray assembly.

Figure 6A:
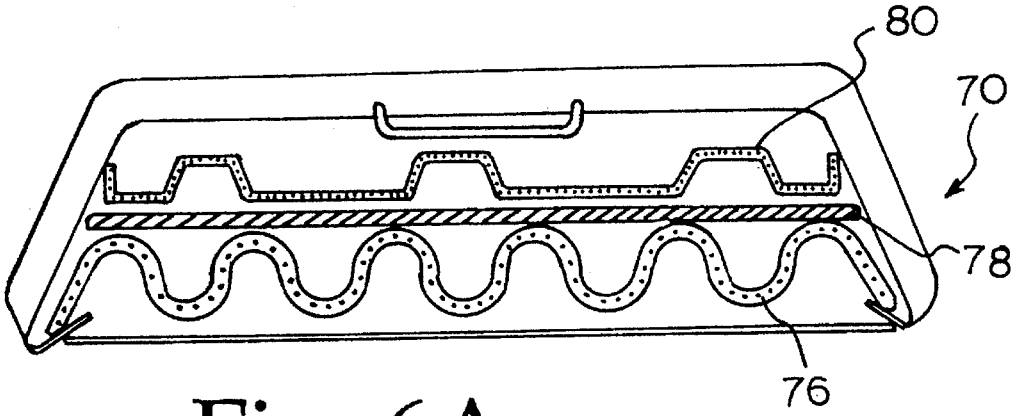
FIG. 6A is a top view of the filtering means of the present invention.
Figure 6B:
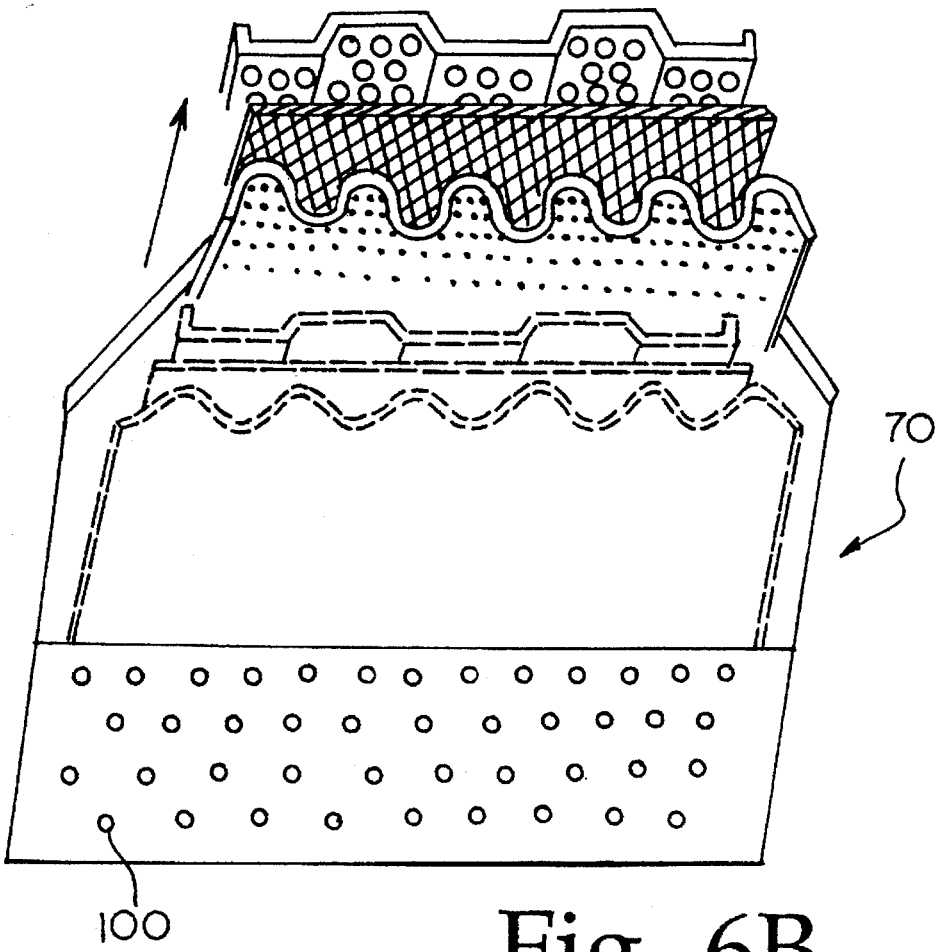
FIG. 6B is a perspective and partially exploded view of the filtering means of the present invention.

During the cleaning sequence the parts basket is rotated and the cleaning spray is directed, as described above, from different directions to cover the parts basket and physically clean dirt and grease from the parts. The dirt and grease is then carried down over the inclined cover member 72 which, directs the wash water into the filter means 70 (FIGS. 6A and 6B) located internally of the casing and towards the front thereof. The wash water flowing over the cover member flows into the filter means 70 via the opening between the cover member and the cover 90 of the filter means. The wash water passes through the screens 76, 78 and 80 in sequence to remove large agglomerated oil and sand particles, etc. The screens preferably include apertures of decreasing size. The wash water is returned to the reservoir 42, via the plurality of apertures located within a front plate 100 of the filtering means 70. The heavier oils and grease sink are effectively removed from the wash water by the filtering means while the lighter ones float on the liquid surface in the reservoir 42. The means 82 for effecting movement of the liquid surface direct the floating oil and grease into the grease collecting means 67. The means 82 for effecting movement of the liquid surface is located beneath the cover member 72 and in the reservoir area 42, comprises interconnected by suitable randomly apertured hosing 86 e.g. polyethylene, P.V.C., etc. The hosing 86 is disposed about the internal periphery of the casing held by suitable positioning means 85 e.g. holding pins. The hosing exits the internal area of the casing 3 for connection with a suitable air source, for example, pump 49. Once the machine has been turned off, the collecting means 67 is drained by drain 98. The suitable air source is admitted into the means 82 via valve 110, while the water is admitted into the reservoir 42 via a valve 112. The air delivered to the hosing 86 causes the wash water beneath the cover member 72 to effervesce which directs the floating oil towards the trough 67. Water entering the reservoir causes the floating oil adjacent the collecting means 67 to spill over therein. The oil and grease therein are then drawn off from the machine through opening 69 which feeds from trough 67. The wash water may be recirculated through pump 49 back to the sprayer and onto the parts. Accordingly, the pump 49 includes a removable filtering means therein which filters out any impurities not filtered by the filter means 70. This ensures that the recycled or recirculated cleaning solution is substantially free of dirt and grease which can lead to blockages in the spray bar assembly.

As earlier mentioned, the industrial washer of the present invention is designed with safety in mind and each of the units illustrated in the drawings incorporates different safety features. In particular, the machine has a vent for venting trapped steam before the machine is opened. The inlet vent 65 which, through pressure differential, automatically provides an intake of fresh air as the steam is vented. In an optional form of the present invention the machine is provided with a timer located in electrical box 22 which operates an internal fan (not shown) for drawing off the steam before the lid can be opened. In other words, the lid can only be lifted after the steam has been cleared as determined by the timer which may operate for example for a period of about 45 seconds after which the lid is released from a locked position for lifting upwardly to gain access to the interior of the machine.

Figure 7A:
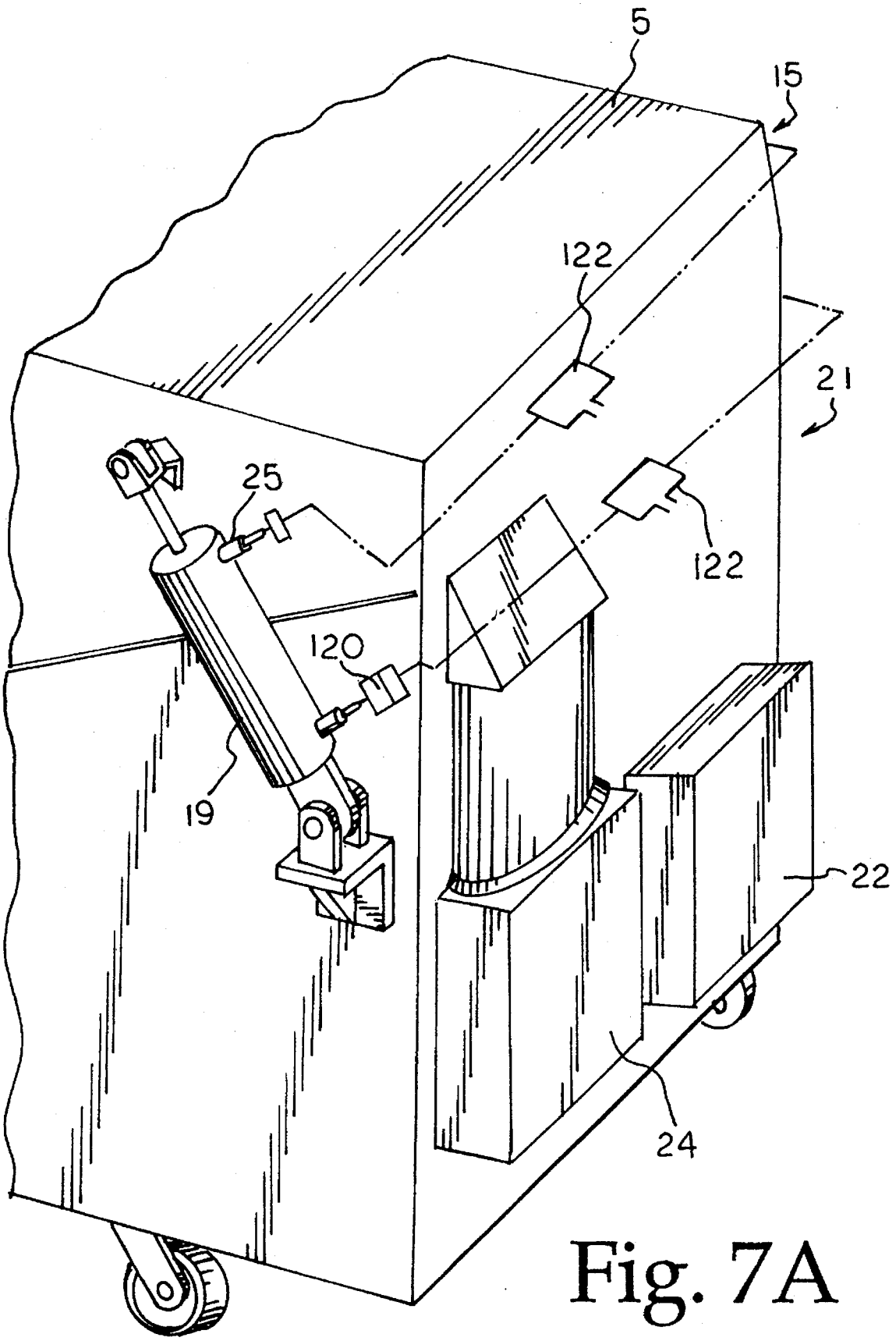
FIG. 7A illustrates a perspective view of the rear of the industrial washer showing the circuit for the actuation means.
Figure 7B:
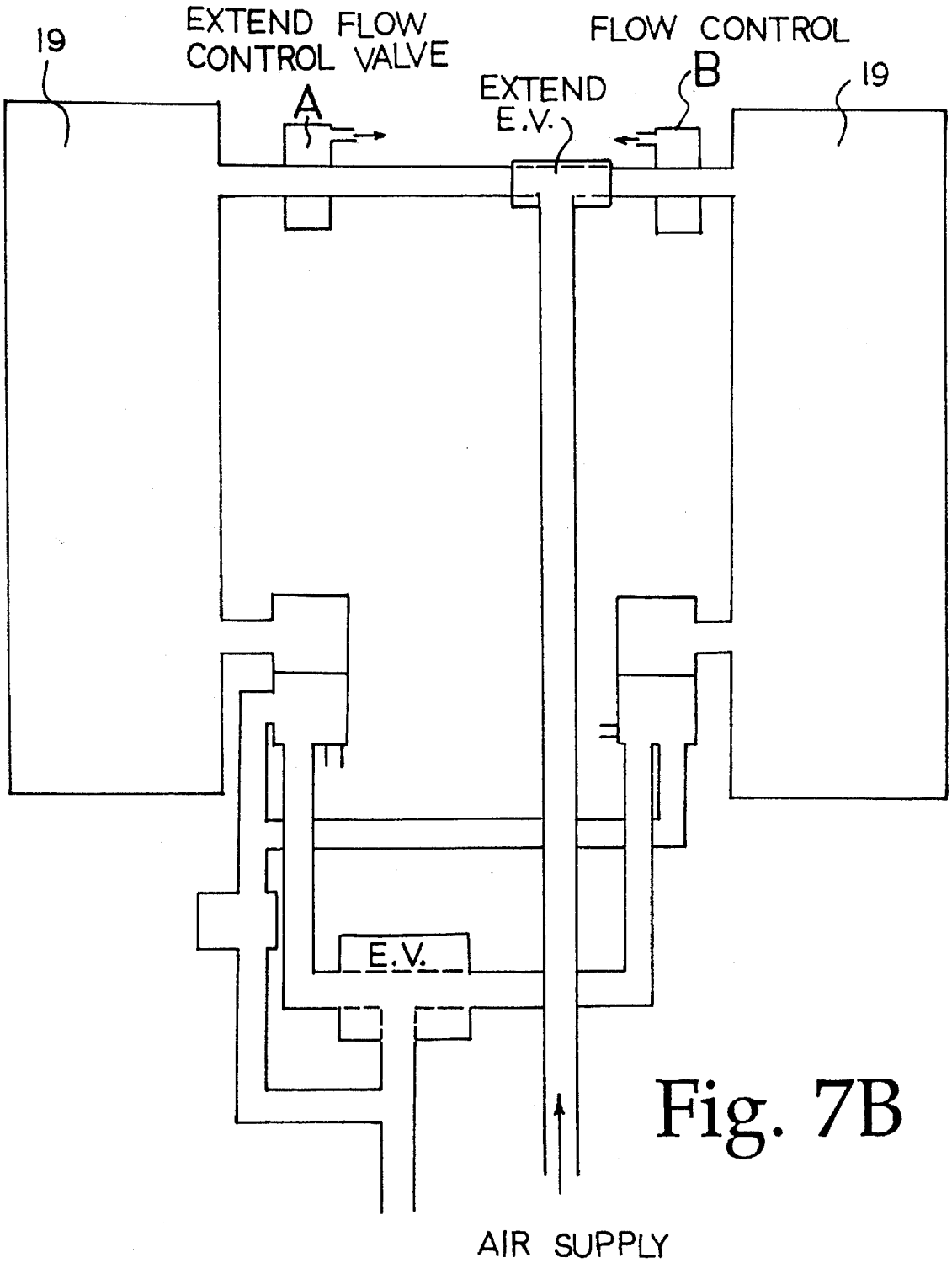
FIG. 7B is a diagrammatic representation of the circuit of the actuation means according to one embodiment of the present invention.

The power lift unit, shown in FIGS. 1 through 5 and 7*a*, under the action of the actuation means. The lid opens to about 90° to allow full interior access for use with an overhead crane or the like. In an embodiment, a specific pneumatic control system including safety features is used to operate the cylinder arms 19. This pneumatic control system is operated by a standard compressor (not shown) which may be included as part of the machine or as a totally separate unit. The compressor feeds air under pressure to one of two selected input lines depending on whether the lid is being lifted or lowered. In the case of lifting the lid the air feeds to a T junction 27 which is connected to air valves 23 at the bottom of each of the double acting cylinders 19 to either side of the machine. In the case of lowering the lid, air is fed to the junction 27 connected to air valve 23 at the top of each cylinder 19. It is preferred that at least one of each of the T junctions include in line poppet valves 120. These valves 120 allow air to move fully therethrough; should the air pressure become disconnected from the system, the poppet valve will close by spring control pressure blocking any air flow not of either cylinder. The cylinders 19 preferably include a pressure equalization valve 122 intermediate the cylinder to ensure equal delivery to each. In the event of electrical power failure, the lid will open automatically. In greater detail of the actuation means for the power lift, reference will now be made to FIGS. 7*a* and 7*b*. Each cylinder 19 is controlled individually by one flow control valve for extending, and one flow control valve for retracting. Additionally, the cylinders 19 include at least one poppet valve 120 connected in line with the retracting flow control valve. The control valves are pre-set on each cylinder to ensure simultaneous extension and retraction of the arms. More particularly, the poppet valves are used as blocking valves, i.e. the valve is air opening with a spring return. A filter lubricator regulator (F.L.R.) which is set to deliver the correct pressure to the cylinders. This control pressure is directed from the output side of the F.L.R. to a T-junction; one output of which connects to a second T-junction. The outputs of this second T-junction are connected to respective poppet valves of each cylinder. In this way, the poppet valve opens allowing air to move freely through a port therein, should the air pressure become suddenly disconnected from any part of the system. The result of such an occurrence causes the poppet valve to close by spring control pressure thus blocking any air flow out of either of the cylinders 19. In the event of electrical power disconnection, the solenoid which communicates with the air compressor will open to allow the hood to automatically lift.

In another embodiment the hydraulic operation of the cylinders 19 can be replaced with hydraulic motion of hydraulic cylinders. These would include bypass valves in substitution for poppet valves. This incoming air pushes on and opens the cylinder arm to lift lid 5. In order to enable the movement of the piston arm, air valve 25 provides a bleed off for air trapped in the cylinder.

The actuation means for the lid may be provided with an override feature in the form of a trip switch which controls the lift system to continue to operate moving the lid to a fully opened position before it can be reclosed. Therefore, in the event that the closure switch is inadvertently hit while the operator is around the unit the lid will continue to lift before moving back downwardly giving the operator ample time to clear away from the machine.

From the above, it will be seen that the industrial washer of the present invention has been designed with an extremely safe and efficient yet low maintenance construction to eliminate both on the job injuries and any substantial shut down time. Furthermore, although various preferred embodiments of the invention have been described in detail, it will be appreciated by those skilled in the art that variations may be made without departing from the spirit of the invention or the scope of the appended claims.

I claim:

1. A surface draining apparatus within an industrial washing machine, the washing machine having a casing with a lid, a liquid reservoir therein and a collecting means associated with said reservoir, said apparatus being adapted to remove a surface layer from a body of liquid in the reservoir into said collecting means;

a cover positioned within said casing and extending over said reservoir covering said collecting means and said liquid reservoir;

filter means associated with said cover and disposed within said casing; and means beneath said cover for injecting air for acting on a surface of a liquid in said liquid reservoir for effecting lateral movement of floating grease and oil from the liquid in said liquid reservoir towards a fixed point for collection of said grease and oil in said collecting means within said casing and whereby wash water from a wash cycle flows laterally over said cover into said filter means for removal of debris, said wash water flowing subsequently into said reservoir and overflowing into said collecting means, and including means for draining collected surface liquid from said collecting means.

2. Apparatus as claimed in claim 1, including spray means for operating at a preset spray pressure, and further including jet means, said apparatus including an overflow relief whereby said overflow relief thus limits a substantial increase in said preset spray pressure on the occurrence of a blockage.

3. Apparatus as claimed in claim 2, said machine including a basket and wherein said spray means is a spray bar with a series of orifices provided therealong and wherein said jet means comprises a substantially open ended conduit offshooting in parallel flow relation from said spray bar, said machine including a pump located adjacent said reservoir for pumping the liquid through said spray bar and in parallel flow relation through said substantially open ended conduit to rotate said basket.

4. Apparatus as claimed in claim 2, said machine including a basket and wherein said basket includes a plurality of vanes positioned to receive the liquid stream from said jet means for rotating said basket.

5. Apparatus as claimed in claim 2, including a pump connected with said reservoir, for use in pumping a liquid through said spray means and said jet means, said pump having an inlet connection within said reservoir in laterally offset relation setting up a circulation current in said reservoir; and said jet means directing the liquid stream onto and rotating said basket in a direction opposite to that of such circulation current wherein said circulation current is effective in assisting braking of said basket.

6. Apparatus claimed in claim 1, including a clean-off trough having an extended edge portion to form a weir adjacent a normal surface level of said cleaning liquid positioned to trap and carry-off greases and oils cleaned from articles in said basket and otherwise floating on the liquid in said reservoir.

7. Apparatus as claimed in claim 1, including a hinged lid for opening and closing said casing.

8. Apparatus as claimed in claim 7, including cylinder and piston arm means connecting said lid to said casing for assisted opening and closing of said lid.

9. Apparatus as claimed in claim 7, including a fluid control system for operating said cylinder and piston arm means to lift and lower said lid.

10. Apparatus as claimed in claim 1, having a recirculation rate of said liquid of between once per minute and once per two minutes.

* * * * *